US006958481B2

(12) United States Patent
Horsky et al.

(10) Patent No.: US 6,958,481 B2
(45) Date of Patent: Oct. 25, 2005

(54) DECABORANE ION SOURCE

(75) Inventors: Thomas N. Horsky, Boxborough, MA (US); Alexander S. Perel, Danvers, MA (US); William K. Loizides, Hollis, NH (US)

(73) Assignee: Axcelis Technologies, Inc., Beverly, MA (US)

( * ) Notice: Subject to any disclaimer, the term of this patent is extended or adjusted under 35 U.S.C. 154(b) by 0 days.

(21) Appl. No.: 09/934,785

(22) Filed: Aug. 22, 2001

(65) Prior Publication Data

US 2001/0054699 A1 Dec. 27, 2001

Related U.S. Application Data

(62) Division of application No. 09/416,159, filed on Oct. 11, 1999, now Pat. No. 6,288,403.

(51) Int. Cl.[7] ..... H01J 27/00; H61N 5/00

(52) U.S. Cl. ..... 250/427; 250/492.21; 250/492.22

(58) Field of Search ..... 250/427, 492.21, 250/492.22

(56) References Cited

U.S. PATENT DOCUMENTS

| | | | | |
|---|---|---|---|---|
| 3,758,777 A | * | 9/1973 | Brunnee et al. | 250/41.9 |
| 5,661,308 A | | 8/1997 | Benveniste et al. | 250/492.21 |
| 5,914,494 A | * | 6/1999 | Abbott | 250/492.21 |
| 6,072,182 A | | 6/2000 | Chutjian et al. | 250/427 |

FOREIGN PATENT DOCUMENTS

JP 10-163123 6/1998

OTHER PUBLICATIONS

K. Goto, J. Matsuo*, T. Sugii, H. Minakata, I. Yamada*, Yamada*, and T. Hisatsugu (Novel Shallow Junction Technology using Decaborane ($B_{10}H_{14}$) * Ion Beam Engineering Experimental Lab., Kyoto University, Sakyo, Kyoto 606–01, Japan.

Daisuke Takeuchi, Norihiro Shimada, Jiro Matsuo and Isao Yamada Ion Beam Engineering Experimental Laboratory, Kyoto University, Sakyo, Kyoto 606–01, Japan (Shallow Junction Formation by Polyatomic Cluster Ion Implantation) Reprinted from IEEE Proceedings of the 11$^{th}$ Int'l Conference on Ion Implantation Technology, Austin, TX, vol. 1, Issue 1, Jun. 16–21, 1996.

Jiro Matsuo, Daisuke Takeuchi, Takaaki Aoki and Isao Yamada Ion Beam Engineering Experimental Laboratory, Kyoto University, Sakyo, Kyoto 606, Japan (Cluster Ion Implantation for Shallow Junction Formation) Reprinted from IEEE Proceedings of the 11$^{th}$ Int'l Conference on Ion Implantation Technology, Austin, TX, vol. 1, Issue 1, Jun. 16–21, 1996.

(Continued)

*Primary Examiner*—Jack Berman
*Assistant Examiner*—Kalimah Fernandez
(74) *Attorney, Agent, or Firm*—John A. Kastelic

(57) ABSTRACT

An ion source (50) for an ion implanter is provided, comprising a remotely located vaporizer (51) and an ionizer (53) connected to the vaporizer by a feed tube (62). The vaporizer comprises a sublimator (52) for receiving a solid source material such as decaborane and sublimating (vaporizing) the decaborane. A heating mechanism is provided for heating the sublimator, and the feed tube connecting the sublimator to the ionizer, to maintain a suitable temperature for the vaporized decaborane. The ionizer (53) comprises a body (96) having an inlet (119) for receiving the vaporized decaborane; an ionization chamber (108) in which the vaporized decaborane may be ionized by an energy-emitting element (110) to create a plasma; and an exit aperture (126) for extracting an ion beam comprised of the plasma. A cooling mechanism (100, 104) is provided for lowering the temperature of walls (128) of the ionization chamber (108) (e.g., to below 350° C.) during ionization of the vaporized decaborane to prevent dissociation of vaporized decaborane molecules into atomic boron ions. In addition, the energy-emitting element is operated at a sufficiently low power level to minimize plasma density within the ionization chamber (108) to prevent additional dissociation of the vaporized decaborane molecules by the plasma itself.

10 Claims, 3 Drawing Sheets

OTHER PUBLICATIONS

Ken–ichi Goto, Jiro Matsuo*, Yoko Tada, Tetsu Tanaka, Youichi Momiyama, Toshihiro Sugii, and Isao Yamada* (A High Performance 50 nm PMOSFET using Decaborane ($B_{10}H_{14}$) Ion Implantation and 2–step Activation Annealing Process * Ion Beam Engineering Experimental Lab., Kyoto University, Sakyo, Kyoto 606–01, Japan.

Roger Smith and Marcus Shaw, Roger P. Webb, Majeed A. Foad (Ultrashallow junctions in Si using decaborane? A Molecular dynamics simulation study) Received Sep. 4, 1997: accepted for publication Dec. 2, 1997).

Majeed A. Foad, Roger Webb, Roger Smith, Erin Jones, Amir Al–Bayati, Mark Lee, Vikas Agrawal, Sanjay Banerjee, Jiro Matsuo, and Isao Yamada (Formation of Shallow Junctions Using Decaborane Molecular Ion Implantation; Comparison With Molecular Dynamics Simulation).

Aditya Agarwal, H.–J. Gossmann, D. C. Jacobson, and D. J. Eaglesham, M. Sosnowski and J. M. Poate, I. Yamada and J. Matsuo, T. E. Haynes (Transient enhanced diffusion from decaborane molecular ion implantation) Received Feb. 4, 1998; accepted for publication Aug. 5, 1998.

Marek Sosnowski, Ravidath Gurudath, John Poate, Anthony Mujsce, Dale Jacobson (Decaborane As Ion Source Material For Boron Implantation).

Ken–ichi Goto, Member, IEEE, Jiro Matsuo, Yoko Tada, Toshihiro Sugii, and Isao Yamada, Member, IEEE (Decaborane ($B_{10}H_{14}$) Ion Implantation Technology for Sub–0.1 $\mu$m PMOSFET's) IEEE Transactions On Electron Devices, vol. 46, No. 4, Apr., 1999.

* cited by examiner

DECABORANE ION SOURCE

RELATED APPLICATION

This application is a divisional patent application of Ser. No. 09/416,159 filed on Oct. 11, 1999 now U.S. Pat. No. 6,288,403. The contents of all of the aforementioned application(s) are hereby incorporated by reference.

The following U.S. patent application, commonly assigned to the assignee of the present invention, is incorporated by reference herein as if it had been fully set forth: application Ser. No. 09/070,685, filed Apr. 30, 1998, and entitled DECABORANE VAPORIZER.

FIELD OF THE INVENTION

The present invention relates generally to ion sources for ion implantation equipment and more specifically to an ion source for ionizing decaborane.

BACKGROUND OF THE INVENTION

Ion implantation has become a standard accepted technology of industry to dope workpieces such as silicon wafers or glass substrates with impurities in the large scale manufacture of items such as integrated circuits and flat panel displays. Conventional ion implantation systems include an ion source that ionizes a desired dopant element which is then accelerated to form an ion beam of prescribed energy. The ion beam is directed at the surface of the workpiece to implant the workpiece with the dopant element. The energetic ions of the ion beam penetrate the surface of the workpiece so that they are embedded into the crystalline lattice of the workpiece material to form a region of desired conductivity. The implantation process is typically performed in a high vacuum process chamber which prevents dispersion of the ion beam by collisions with residual gas molecules and which minimizes the risk of contamination of the workpiece by airborne particulates.

Ion dose and energy are the two most important variables used to define an implant step. Ion dose relates to the concentration of implanted ions for a given semiconductor material. Typically, high current implanters (generally greater than 10 milliamps (mA) ion beam current) are used for high dose implants, while medium current implanters (generally capable up to about 1 mA beam current) are used for lower dose applications. Ion energy is used to control junction depth in semiconductor devices. The energy of the ions which make up the ion beam determine the degree of depth of the implanted ions. High energy processes such as those used to form retrograde wells in semiconductor devices require implants of up to a few million electron volts (MeV), while shallow junctions may only demand energies below 1 thousand electron volts (keV).

The continuing trend to smaller and smaller semiconductor devices requires implanters with ion sources that serve to deliver high beam currents at low energies. The high beam current provides the necessary dosage levels, while the low energy levels permit shallow implants. Source/drain junctions in complementary metal-oxide-semiconductor (CMOS) devices, for example, require such a high current, low energy application.

A typical ion source 10 for obtaining atoms for ionization from a solid form is shown in FIG. 1. The ion source comprises a pair of vaporizers 12 and 14 and an ionization chamber 16. Each of the vaporizers is provided with a crucible 18 in which a solid element or compound is placed and which is heated by a heater coil 20 to vaporize the solid source material. Heater coil leads 22 conduct electrical current to the heater coils and thermocouples 24 provide a temperature feedback mechanism. Air cooling conduit 26 and water-cooling conduit 28 is also provided.

Vaporized source material passes through a nozzle 30, which is secured to the crucible 18 by a graphite nozzle retainer 32, and through vaporizer inlets 34 to the interior of the ionization chamber 16. Alternatively, compressed gas may be fed directly into the ionization chamber by means of a gas inlet 36 via a gas line 38. In either case, the gaseous/vaporized source material is ionized by an arc chamber filament 40 that is heated to thermionically emit electrons.

Conventional ion sources utilize an ionizable dopant gas which is obtained either directly from a source of a compressed gas or indirectly from a solid which has been vaporized. Typical source elements are boron (B), phosphorous (P), gallium (Ga), indium (In), antimony (Sb), and arsenic (As). Most of these source elements are commonly used in both solid and gaseous form, except boron, which is almost exclusively provided in gaseous form, e.g., as boron trifluoride ($BF_3$).

In the case of implanting boron trifluoride, a plasma is created which includes singly charged boron (B+) ions. Creating and implanting a sufficiently high dose of boron into a substrate is usually not problematic if the energy level of the beam is not a factor. In low energy applications, however, the beam of boron ions will suffer from a condition known as "beam blow-up", which refers to the tendency for like-charged ions within the ion beam to mutually repel each other. Such mutual repulsion causes the ion beam to expand in diameter during transport, resulting in vignetting of the beam by multiple apertures in the beamline. This severely reduces beam transmission as beam energy is reduced.

Decaborane ($B_{10}H_{14}$) is a compound which is an excellent source of feed material for boron implants because each decaborane molecule ($B_{10}H_{14}$) when vaporized and ionized can provide a molecular ion comprised of ten boron atoms. Such a source is especially suitable for high dose/low energy implant processes used to create shallow junctions, because a molecular decaborane ion beam can implant ten times the boron dose per unit of current as can a monatomic boron ion beam. In addition, because the decaborane molecule breaks up into individual boron atoms of roughly one-tenth the original beam energy at the workpiece surface, the beam can be transported at ten times the energy of a dose-equivalent monatomic boron ion beam. This feature enables the molecular ion beam to avoid the transmission losses that are typically brought about by low energy ion beam transport.

However, decaborane ion sources to date have been unsuccessful at generating sufficient ion beam current for production applications of boron implants. Known hot-cathode sources are unsuitable for decaborane ionization because the heat generated by the cathode and arc in turn heats the walls and components to greater than 500° C., causing dissociation of the decaborane molecule into borane fragments and elemental boron. Known plasma-based sources are unsuitable for decaborane ionization because the plasma itself can cause dissociation of the decaborane molecule and fragmentation of the $B_{10}H_X^+$ desired parent ion. Accordingly, in known decaborane ion sources, the source chamber pressure is kept sufficiently low to prevent the sustenance of a local plasma. Thus far, ion beam currents developed from such a source are too low for production applications.

Accordingly, it is an object of the present invention to provide an ion source for an ion implanter, which can accurately and controllably ionize sufficient decaborane to produce acceptable production ion beam current levels, to overcome the deficiencies of known ion sources.

SUMMARY OF THE INVENTION

An ion source for an ion implanter is provided, comprising a vaporizer and a remotely located ionizer connected to the vaporizer by a feed tube. The vaporizer comprises a sublimator for receiving a solid source material such as decaborane and sublimating (vaporizing) the decaborane. A heating mechanism is provided for heating the sublimator, and the feed tube connecting the sublimator to the ionizer, to maintain a suitable temperature for the vaporized decaborane.

The ionizer comprises a body having an inlet for receiving the vaporized decaborane; an ionization chamber in which the vaporized decaborane may be ionized by an energy-emitting element to create a plasma; and an exit aperture for extracting an ion beam comprised of the plasma. A cooling mechanism is provided for lowering the temperature of walls of the ionization chamber (e.g., to below 350° C.) during the ionization of the vaporized decaborane to prevent dissociation of vaporized decaborane molecules into atomic boron ions. In addition, the energy-emitting element is operated at a sufficiently low power level to minimize plasma density within the ionization chamber to prevent additional dissociation of the vaporized decaborane molecules by the plasma itself.

DETAILED DESCRIPTION OF A PREFERRED EMBODIMENT OF THE INVENTION

Figure 1:
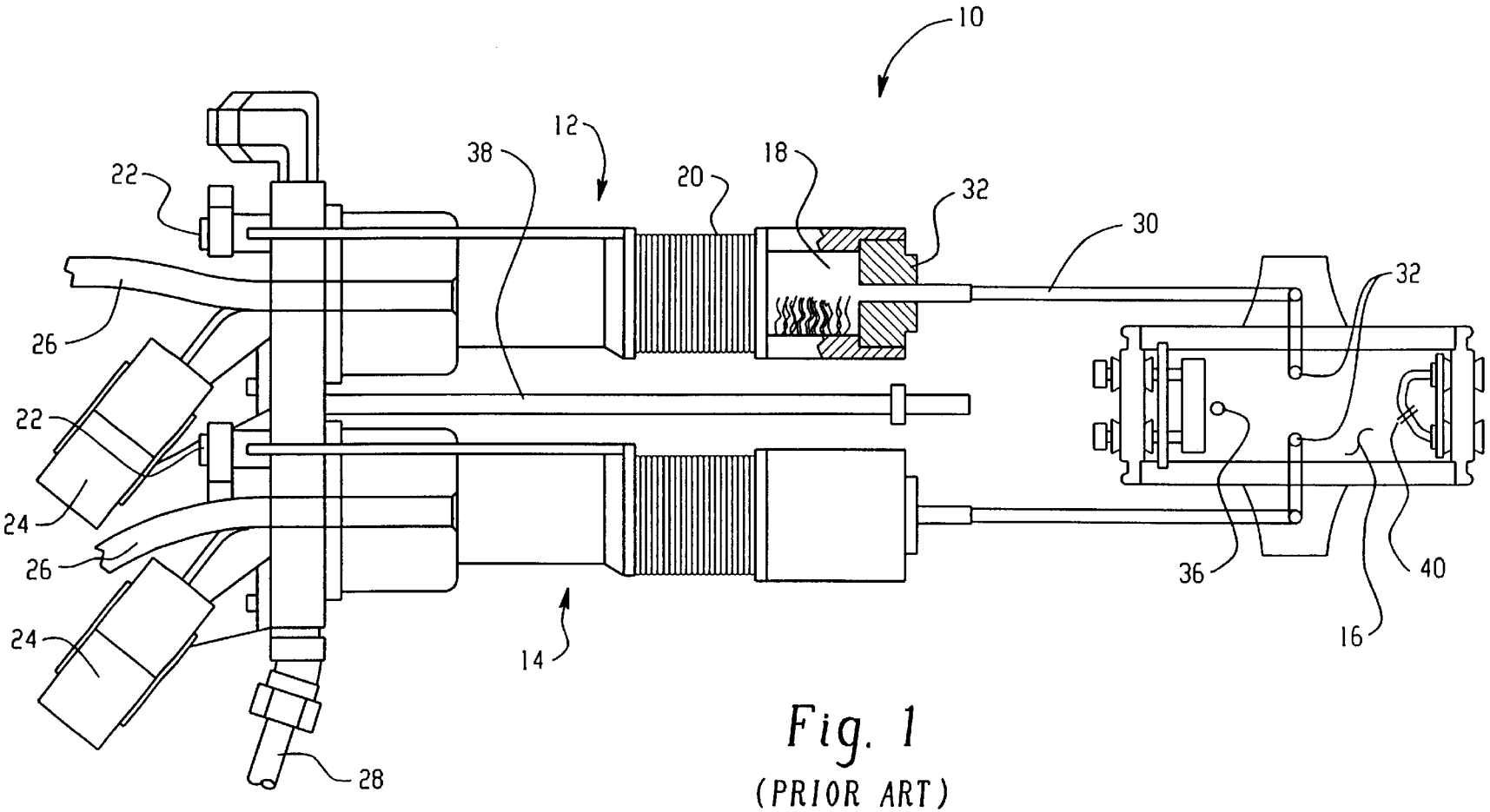
Fig. 1 (PRIOR ART)
FIG. 1 is a perspective, partially cross sectional view of a conventional ion source for an ion implanter.
Figure 3:
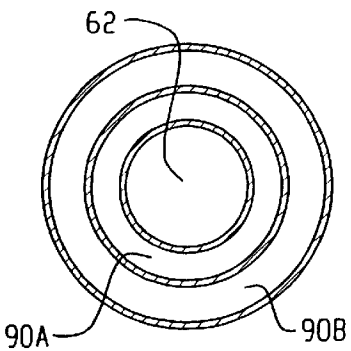
FIG. 3 is a cross sectional view of a connecting tube of an alternative embodiment of the ion source of FIG. 2, taken along the lines 3—3.
Figure 2:
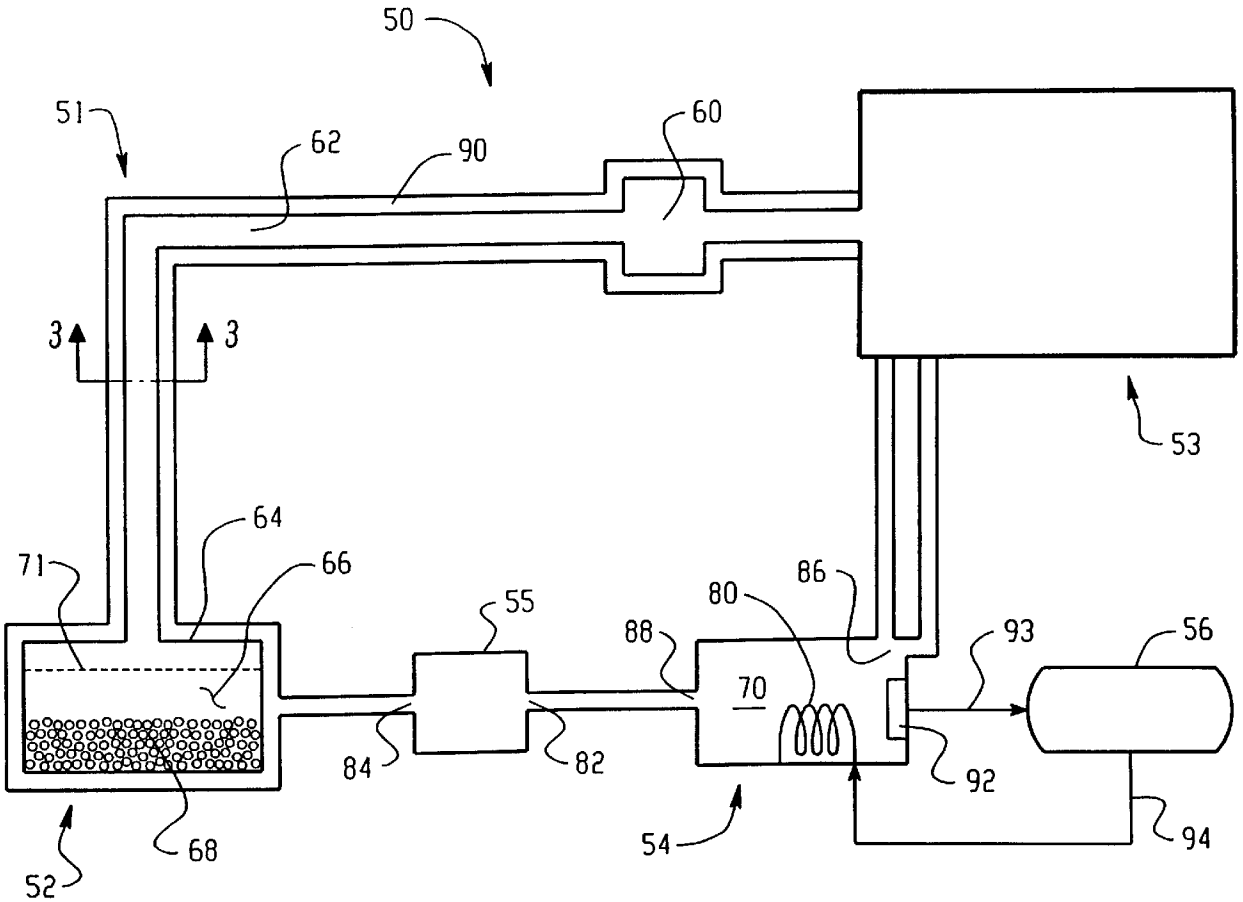
FIG. 2 is a schematic, partially cross sectional view of a first embodiment of an ion source for an ion implanter constructed according to the principles of the present invention.
Figure 4:
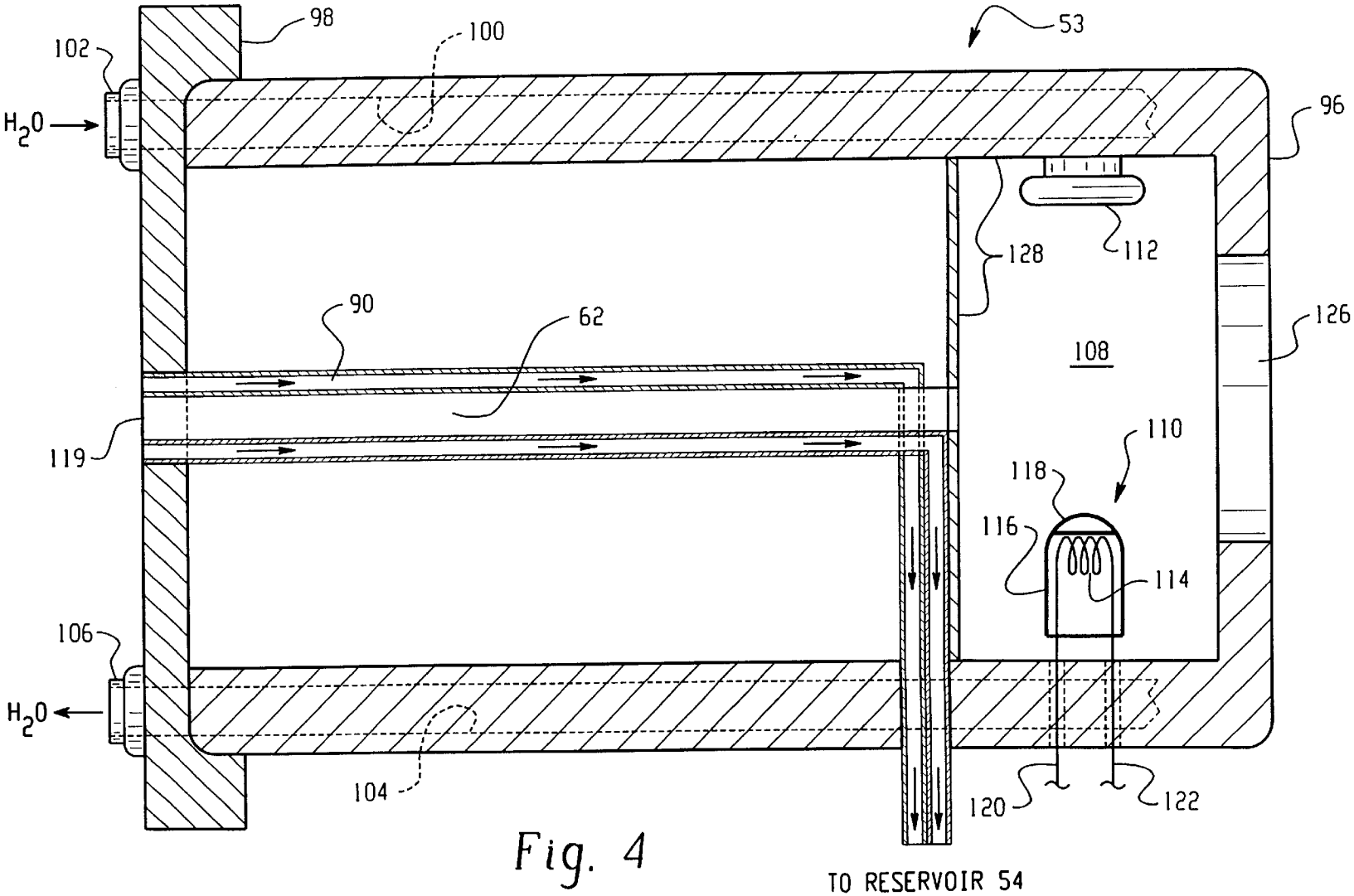
FIG. 4 is a partially cross sectional view of the ionizer portion of the ion source of FIG. 2.

Referring now to FIGS. 2–4 of the drawings, and initially to FIG. 2, an ion source 50 comprising a vaporizer 51 and an ionizer 53 are shown, constructed according to the present invention. The vaporizer 51 comprises a non-reactive, thermally conductive sublimator or crucible 52, a heating medium reservoir 54, a heating medium pump 55, a temperature controller 56, and a mass flow controller 60. Ionizer 53 is shown in more detail in FIG. 3. The crucible 52 is located remotely from the ionizer 53 and connected thereto by a feed tube 62, constructed of quartz or stainless steel. In the disclosed embodiment, the feed tube 62 is surrounded by an outer single-chamber annular sheath 90 along substantially the entire length thereof.

The crucible 52 provides a container 64 enclosing a cavity 66 for containing a source material 68. The container is preferably made of a suitable non-reactive (inert) material such as stainless steel, graphite, quartz or boron nitride and which is capable of holding a sufficient amount of source material such as decaborane ($B_{10}H_{14}$). Although the invention is described further below only in terms of decaborane, it is contemplated that the principles of the present invention may be used for other molecular solid source materials, such as indium trichloride ($InCl_3$), which are characterized as having both low melting points (i.e., sublimation temperatures of between 20° C. and 250° C.) and significant room temperature vapor pressures (i.e. between $10^{-2}$ Torr and $10^{3}$ Torr).

The decaborane is vaporized through a process of sublimation by heating the walls of the container 64 with a heating medium 70 contained in reservoir 54. A wire mesh 71 prevents non-vaporized decaborane from escaping the crucible 52. Completely vaporized decaborane exits the crucible 52 via feed tube 62 and enters mass flow controller 60, which controls the flow of vapor, and thus meters the amount of vaporized decaborane which is provided to the ionizer 53, as is known in the art.

Alternatively, in a second embodiment of the invention, the feed tube 62 is provided in the form of a capillary tube and sheath 90 is provided in the form of a coaxial dual-chamber sheath, comprising an inner sheath 90A surrounded by an outer sheath 90B (see FIG. 3). The heating medium may be pumped into the inner sheath 90A (located adjacent the capillary tube 62) and pumped out of the outer sheath 90B (located radially outward from the inner sheath 90A). In this second embodiment, the mass flow controller 60 is replaced with a heated shut-off valve (not shown) located at the feed tube/ionizer interface, and mass flow is increased or decreased by directly changing the temperature of the reservoir 54. Alternatively, a separate heat source may be provided for the shut-off valve. The arrangement of the coaxial sheath surrounding the capillary tube has the advantage of providing an insulating sheath surrounding the inner diameter of the capillary tube, thereby resulting in a more uniform temperature.

The ionizer 53 is shown in more detail in FIG. 4. The ionizer 53 comprises a generally cylindrical body 96 and a generally annular base or mounting flange 98, both in the preferred embodiment constructed of aluminum. Aluminum does not pose significant contamination problems. The body 96 is preferably constructed of a single machined piece of aluminum to facilitate water cooling as described below. In addition, aluminum provides good thermal conductivity.

The aluminum body 96 is cooled by means of entry cooling passageway 100 fed by inlet 102 and exit cooling passageway 104 which exits body 96 via outlet 106. The cooling medium may be water or any other suitable fluid having high heat capacity. The entry and exit cooling passageways provide a continuous pathway by which water flows therethrough to cool the ionizer body 96. Although only a fragmented portion of the pathway is shown in phantom in FIG. 4, the pathway may extend near and about the outer periphery of the body in any known configuration to insure that the entire body is effectively cooled. By cooling the body 96, an ionization chamber 108 within the ionizer 53 may be maintained at a temperature low enough (less than 350° C.) to prevent dissociation of the ionized decaborane molecule.

Within the confines of the ionizer body 96 are an extension of the feed tube 62, surrounded by annular sheath 90, terminating at ionization chamber 108. Within the ionization chamber reside a hot cathode 110 and an anti-cathode or repeller 112. The hot cathode 110 comprises a heated filament 114 surrounded by a cylinder 116 and capped by endcap 118. In the preferred embodiment, the filament and the endcap are made of tungsten, and the cylinder is made of molybdenum. The heated filament 114 is energized via power feedthroughs 120 and 122 that pass through and are electrically insulated from the aluminum body 96. The repeller 112 is also electrically insulated from the body 96, via a thermally conductive electrically insulating material (such as sapphire) which physically couples the repeller to the cooled ionization chamber 108.

In operation, the vaporized material is injected into the ionization chamber via feed tube 62 at ionizer inlet 119. When the tungsten filament 114 is energized electrically by application of a potential difference across feedthroughs 120 and 122, the filament emits electrons that accelerate toward and impact endcap 118. When the endcap 118 is sufficiently heated by electron bombardment, it in turn emits electrons into the ionization chamber 108 that strike the vaporized gas molecules to create ions in the chamber.

A low-density ion plasma is thereby created, from which an ion beam is extracted from the chamber through source aperture 126. The low density of the plasma in chamber 108 is in part provided by the relatively low arc discharge power maintained in the source (about 5 watts (W) at 50 milliamps (mA)). The endcap 118 shields the filament 114 from contact with the low-density plasma and thereby extends the lifetime of the filament. The indirectly heated cathode arrangement shown in FIG. 4 may be replaced by other conventional source devices, for example simple filaments as used in Freeman-type or Bernas-type ion sources.

Electrons generated by cathode 110 which do not strike a decaborane molecule in the ionization chamber to create a decaborane ion move toward the repeller 112, which deflects these electrons back toward the cathode. The repeller is preferably constructed of molybdenum and, like the cathode, is electrically insulated from the ionizer body 96. The repeller may be water-cooled if it is found that minimal decaborane molecule dissociation is being caused by the repeller (or physically coupled to the body 96 using an electrical insulator with high thermal conductivity).

Walls 128 of the ionization chamber 108 are maintained at local electrical ground potential. The cathode 110, including endcap 118, is maintained at a potential of approximately 50 to 150 volts below the potential of the walls 128. The filament 114 is maintained at a voltage approximately between 200 and 600 volts below the potential of the endcap 118. The large voltage difference between the filament 114 and the endcap 118 imparts a high energy to the electrons emitted from the filament to sufficiently heat endcap 118 to thermionically emit electrons into the ionization chamber 108.

Alternatively, instead of the cathode/repeller combination shown in FIG. 4, an RF exciter (not shown) such as an antenna may be energized to emit an RF signal that ionizes the vaporized decaborane molecules in the chamber 108 to create a plasma. The power associated with such an RF antenna is on the order of 40 W–50 W. A magnetic filter (not shown) also disposed within the chamber 108 filters the plasma, and extractor electrodes (not shown) located outside source aperture 126 extract the plasma from the ionization chamber as is known in the art. Alternatively still, microwave energy may be directed from a microwave source to the ionization chamber 108 to ionize the vaporized decaborane molecules to create a plasma.

The inventive ion source 50 provides a control mechanism for controlling the operating temperature of the crucible 52, as well as that of the feed tube 62 through which vaporized decaborane passes on its way to and through the ionizer 53. The heating medium 70 is heated within the reservoir 54 by a resistive or similar heating element 80 and cooled by a heat exchanger. The temperature control means comprises a temperature controller 56 which obtains as an input temperature feedback from the reservoir 54 via thermocouple 92, and outputs a control signal to heating element 80, as further described below, so that the heating medium 70 in the reservoir is heated to a suitable temperature. The operating temperature control mechanism for heating the both the vaporizer 51 and the feed tube in the ionizer 53 may be provided by a single circuit, as shown in FIGS. 2 and 4. Alternatively, separate temperature control circuits may be provided for the vaporizer 51 and the ionizer 53.

The heating medium 70 comprises mineral oil or other suitable medium (e.g., water) that provides a high heat capacity. The oil is heated to a temperature within the 20° C. to 250° C. range by the heating element 80 and circulated by pump 55 around the crucible 52 and the feed tube 62 through sheath 90. The pump 55 is provided with an inlet and an outlet 82 and 84, respectively, and the reservoir 54 is similarly provided with an inlet 86 and an outlet 88, respectively. The flow pattern of the heating medium about the crucible 52 and the feed tube 62, although shown in a unidirectional clockwise pattern in FIG. 2, may be any pattern that provides reasonable circulation of the medium about the crucible 52 and the feed tube 62.

Referring back to FIG. 2, the crucible cavity 66 is pressurized in order to facilitate material transfer of the vaporized (sublimated) decaborane from the crucible 52 to the ionization chamber 108 through the feed tube 62. As the pressure within cavity 66 is raised, the rate of material transfer correspondingly increases. The ionization chamber operates at a near vacuum (about 1 millitorr), and thus, a pressure gradient exists along the entire length of the feed tube 62, from the crucible 52 to the ionization chamber 108. The pressure of the crucible is typically on the order of 1 torr.

By locating the crucible 52 remotely from the ionization chamber 108, the material within crucible cavity 66 is thermally isolated, thereby providing a thermally stable environment unaffected by the temperature in the ionization chamber. As such, the temperature of the crucible cavity 66, in which the process of decaborane sublimation occurs, may be controlled independently of the operating temperature of the ionization chamber 108 to a high degree of accuracy (within 1° C.). Also, by maintaining a constant temperature of the vaporized decaborane during transport to the ionization chamber via the heated feed tube 62, no condensation or thermal decomposition of the vapor occurs.

The temperature controller 56 controls the temperature of the crucible 52 and the feed tube 62 by controlling the operation of the heating element 80 for the heating medium reservoir 70. Thermocouple 92 senses the temperature of the reservoir 70 and sends temperature feedback signal 93 to the temperature controller 56. The temperature controller responds to this input feedback signal in a known manner by outputting control signal 94 to the reservoir heating element 80. In this manner, a uniform temperature is provided for all surfaces to which the solid phase decaborane and vaporized decaborane are exposed, up to the location of the ionization chamber.

By controlling the circulation of the heating medium in the system (via pump 55) and the temperature of the heating medium (via heating element 80), the ion source 50 can be controlled to an operating temperature of on the order of 20° C. to 250° C. (+/−1° C.). Precise temperature control is more critical at the crucible, as compared to the end of the feed tube nearest the ionization chamber, to control the pressure of the crucible and thus the vapor flow rates out of the crucible.

Because the plasma density using the inventive source is kept low (on the order $10^{10}/cm^3$) to prevent dissociation of the decaborane molecule, total extracted ion beam current will be low when using a conventionally-sized source aperture. Assuming a comparable beam current density, the aperture 126 in the ionizer 53 of the present invention is made large enough to insure an adequate ion beam current output. A 1 $cm^2$ (0.22 cm×4.5 cm) aperture permits a beam current density of about 100 microamps per square centimeter ($\mu A/cm^2$) at the workpiece (i.e., 1 $\mu$A), and up to (less than or equal to) 1 $mA/cm^2$ of extracted beam current from the source (i.e., 1 mA). (The actual focused beam current delivered to the workpiece is only a fraction of the total extracted beam current.) Aperture sizes of about 5 $cm^2$ are possible in some implanters, which would yield a $B_{10}H_x^+$ beam current of about 500 $\mu$A at the workpiece. In ultra low energy (ULE) implanters, even larger aperture sizes (up to 13 $cm^2$) are possible.

Using either embodiment of the source 50 of FIG. 2 in an ion implanter, an entire molecule (ten boron atoms) is implanted into the workpiece. The molecule breaks up at the workpiece surface such that the energy of each boron atom is roughly one-tenth the energy of the ten-boron cluster (in the case of $B_{10}H_{14}$). Thus, the beam can be transported at ten times the desired boron implantation energy, enabling very shallow implants without significant beam transmission losses. In addition, at a given beam current, each unit of current delivers ten times the dose to the workpiece. Finally, because the charge per unit dose is one-tenth that of a monatomic beam implant, workpiece charging problems are much less severe for a given dose rate.

Accordingly, a preferred embodiment of an improved ion source for an ion implanter has been described. With the foregoing description in mind, however, it is understood that this description is made only by way of example, that the invention is not limited to the particular embodiments described herein, and that various rearrangements, modifications, and substitutions may be implemented with respect to the foregoing description without departing from the scope of the invention as defined by the following claims and their equivalents.

What is claimed is:

1. An ion source (50) comprising:

(i) a vaporizer (51) having a cavity (66) for receiving a source material (68) to be vaporized and for vaporizing the source material;

(ii) an ionizer (53) located remotely from said vaporizer (51), said ionizer comprising a body (96) having an inlet (119) for receiving the vaporized source material; an ionization chamber (108) in which the vaporized source material may be ionized by an energy-emitting element to create a plasma; an exit aperture (126) for extracting an ion beam comprised of said plasma; and a cooling mechanism (100, 104) for lowering the temperature of walls (128) of said ionization chamber (108) during the ionization of said vaporized material;

(iii) a feed tube (62) for connecting said vaporizer (51) to said ionization chamber (108); and (iv) a heating medium (70) for heating at least a portion of said vaporizer (51) and said feed tube (62).

2. The ion source (50) of claim 1, wherein said vaporized material is vaporized decaborane.

3. The ion source (50) of claim 2, further comprising a control mechanism for controlling the temperature of said heating medium (70).

4. The ion source (50) of claim 2, wherein said energy-emitting element is a radio frequency (RF) exciter.

5. The ion source (50) of claim 2, wherein said energy-emitting element is a microwave source.

6. The ion source (50) of claim 2, wherein said body (96) is generally cylindrical in shape and constructed of aluminum.

7. The ion source (50) of claim 2, wherein said cooling mechanism comprises one or more passageways (100, 104) through which a cooling medium may be circulated.

8. The ion source (50) of claim 2, wherein said cooling mechanism maintains said walls (128) of said ionization chamber (108) below 350° C. to prevent dissociation of vaporized decaborane molecules.

9. The ion source (50) of claim 2, wherein said aperture (126) is sized to provide a focused ion beam current of between 100–500 microamps ($\mu$A) at a beam current density of <1 milliamp per square centimeter ($mA/cm^2$).

10. The ion source (50) of claim 2, wherein said plasma has a density within said chamber (108) on the order of $10^{10}/cm^3$.

* * * * *